US007108478B2

(12) United States Patent
Hancock

(10) Patent No.: US 7,108,478 B2
(45) Date of Patent: Sep. 19, 2006

(54) BLOWER HOUSING AND CABINET WITH IMPROVED BLOWER INLET AIRFLOW DISTRIBUTION

(75) Inventor: Stephen S. Hancock, Flint, TX (US)

(73) Assignee: American Standard International Inc., New York, NY (US)

( * ) Notice: Subject to any disclaimer, the term of this patent is extended or adjusted under 35 U.S.C. 154(b) by 0 days.

(21) Appl. No.: 10/810,877

(22) Filed: Mar. 26, 2004

(65) Prior Publication Data

US 2004/0253098 A1 Dec. 16, 2004

Related U.S. Application Data

(63) Continuation-in-part of application No. 10/461,042, filed on Jun. 13, 2003, now Pat. No. 7,014,422.

(51) Int. Cl.
*F04D 25/00* (2006.01)

(52) U.S. Cl. ..... 415/108; 415/177; 415/206

(58) Field of Classification Search ..... 415/108, 415/206, 177, 244
See application file for complete search history.

(56) References Cited

U.S. PATENT DOCUMENTS 3,340,788 A * 9/1967 Landingham et al. ..... 454/59
4,420,034 A * 12/1983 VanderVaart ..... 165/240
5,042,269 A * 8/1991 Sullivan ..... 62/285
5,474,422 A * 12/1995 Sullivan ..... 415/206
6,155,070 A 12/2000 Rust, Jr. et al.

FOREIGN PATENT DOCUMENTS

FR 2 797 683 8/1999
WO WO 98/15785 4/1998

OTHER PUBLICATIONS

Publication: "The Leader", Title: "New Air Handler Features Better Performance in a Smaller Cabinet", Spring 2004, p. 6, vol. 13, Issue 1.

* cited by examiner

*Primary Examiner*—Ninh H. Nguyen
(74) *Attorney, Agent, or Firm*—William J. Beres; William O'Driscoll

(57) ABSTRACT

An airhandling unit for an HVAC system includes a cabinet having an electric motor driven centrifugal blower disposed therein. The blower includes a scroll or volute type blower housing which may be formed of opposed releasably connectable housing parts. The blower housing parts include opposed sidewalls with axially extending compound curved portions which cooperate with an end wall which is configured to have portions which are not of substantially constant increasing radial distance from the blower impeller axis of rotation. However, a constantly increasing airflow cross-sectional flow area is provided within the blower housing for blower discharge air. The disposition of the blower housing sidewalls with respect to the cabinet walls provides improved airflow distribution for air flowing into the blower air inlet openings.

14 Claims, 6 Drawing Sheets

BLOWER HOUSING AND CABINET WITH IMPROVED BLOWER INLET AIRFLOW DISTRIBUTION

CROSS-REFERENCE TO RELATED APPLICATION

This application is a continuation-in-part of U.S. patent application Ser. No. 10/461,042, filed Jun. 13, 2003 now U.S. Pat. No. 7,014,422.

BACKGROUND OF THE INVENTION

Centrifugal airhandling blowers are widely used for circulating air in residential and commercial heating, ventilating and air conditioning (HVAC) systems. Electric motor driven centrifugal blowers or fans mounted in volute or scroll type blower housings are particularly widely used in HVAC systems wherein the blower housing is mounted in a cabinet which may also contain heat transfer equipment such as a refrigerant fluid heat exchanger or a furnace heat exchanger, for example.

One problem faced by prior art airhandling blowers is the inability to expand the capacity of the blower within a given cabinet size beyond a certain blower housing size, since the physical dimensions of the blower housing of increased capacity prevent installation in a cabinet without redesigning or increasing the size of the cabinet itself. To this end, a blower housing of the type described herein and in the above-referenced patent application has been developed. However, further improvements in the efficiency and airflow capacity of a blower, including a blower housing of the type generally as described in the above-referenced patent application, in combination with a cabinet, such as an air handler cabinet or furnace cabinet, have been realized in accordance with the present invention.

SUMMARY OF THE INVENTION

The present invention provides an improved airhandling blower and cabinet combination wherein the configuration of the blower housing and its location within and with respect to the cabinet provides for improved inlet airflow to the blower.

In accordance with one aspect of the present invention, a cabinet for containing a heat exchanger and for routing airflow therethrough includes a blower characterized by a blower housing which has a substantially constantly increasing cross-sectional air flow area between a so-called impeller cutoff point and a blower air discharge opening wherein the cross-sectional flow area is defined by an end wall of the blower housing which is at an increasing radial distance from an axis of rotation of a blower impeller over a portion of the housing and air flowpath and by a changing axial dimension of the sidewalls of the blower housing over another portion of the air flowpath.

The combination of axial and radial dimensional changes of the housing walls with respect to the blower impeller axis of rotation permits the installation of a blower in a cabinet of a predetermined size and wherein the blower has an increased capacity, and further wherein the combination exhibits an improved distribution of airflow into the air inlets of the blower. Accordingly, a more efficient airhandling apparatus is provided which may also be more quiet than prior art airhandling apparatus.

Those skilled in the art will further appreciate the merits of the present invention upon reading the detailed description which follows in conjunction with the drawings.

DETAILED DESCRIPTION OF THE PREFERRED EMBODIMENT

Figure 1:
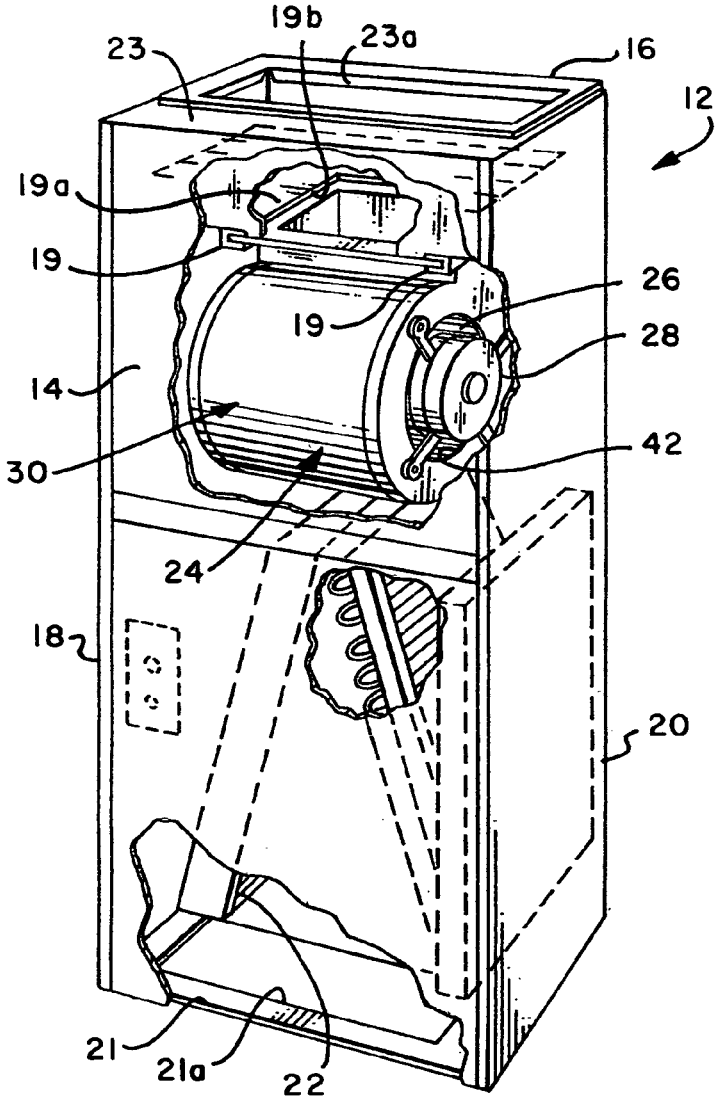
FIG. 1 (PRIOR ART)
FIG. 1 is a cutaway perspective view of an airhandling apparatus including a prior art combination of a cabinet and a centrifugal blower mounted therein.

In the description which follows, like parts are marked throughout the specification and drawings with the same reference numerals, respectively. The drawing figures may not, in all instances, be to scale in the interest of clarity and conciseness.

Referring to FIG. 1, there is illustrated an example of a prior art airhandling unit for an HVAC system comprising a generally rectangular metal cabinet 12 having a front wall 14, a back wall 16 and opposed sidewalls 18 and 20. A bottom wall 21 may have a suitable air inlet opening 21*a* therein for allowing air to enter the cabinet 12 and pass through a heat exchanger 22, such as a so-called A-frame air conditioning evaporator coil, as shown. Air is induced into the cabinet 12 by a centrifugal, electric motor driven blower 24 having a conventional centrifugal impeller 26, see FIG. 2, also, driven by a conventional electric motor 28, FIG. 1. Air is discharged from blower 24 into a plenum 17, FIG. 3, and then through an opening 23*a* in a cabinet top wall 23, FIGS. 1 and 3.

Figure 2:
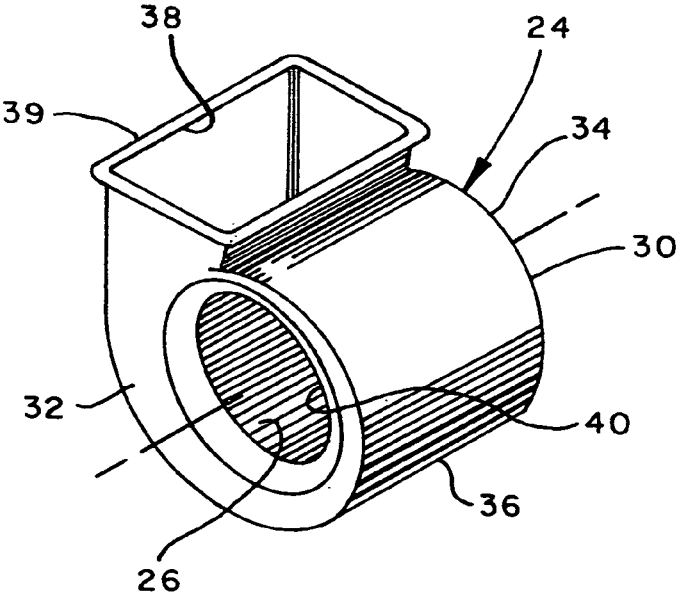
FIG. 2 (PRIOR ART)
FIG. 2 is a perspective view of a prior art blower including a blower housing of the type illustrated in FIG. 1.
Figure 3:
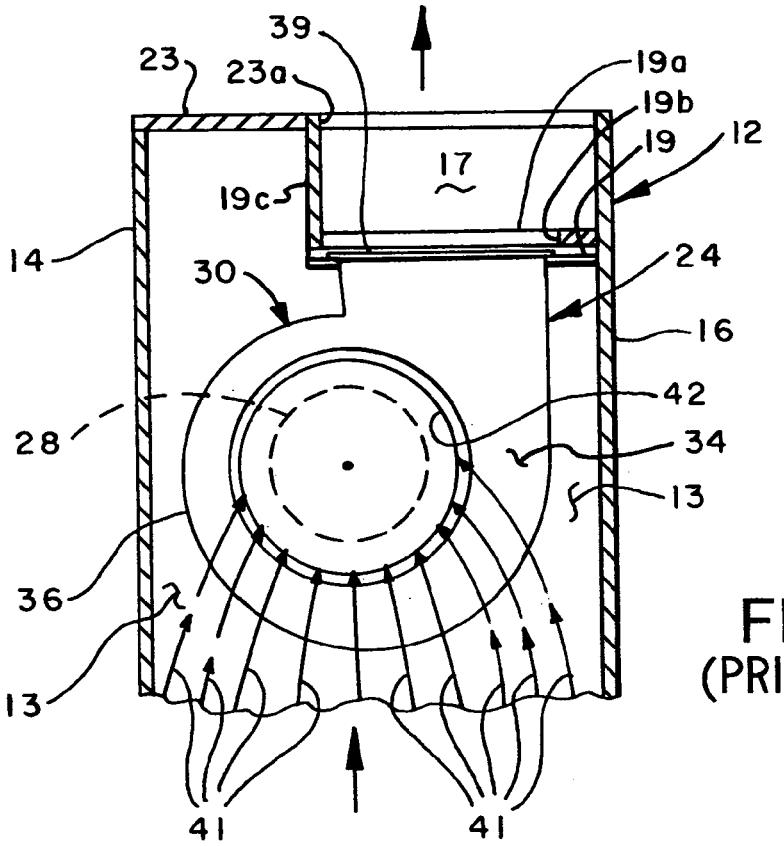
FIG. 3 (PRIOR ART)
FIG. 3 is a vertical section view of the blower housing and cabinet illustrated in FIG. 1, in somewhat schematic form, showing the flow lines of air flowing to the blower housing air inlet.

As further shown in FIGS. 1 and 2, the blower 24 includes a conventional blower housing 30 having opposed, spaced apart, generally flat, parallel sidewalls 32 and 34, and a continuous spiral end wall 36 extending to a flanged blower outlet opening 38. Opposed blower air inlet openings 40 and 42 are formed in the sidewalls 32 and 34, respectively. Blower 24 is supported within the interior of the cabinet 12 by a perimeter flange 39, FIGS. 2 and 3, which is engageable with opposed support rails 19, one shown in FIG. 3, which are preferably mounted on or formed as part of a transverse intermediate horizontal wall 19*a*, see FIGS. 1, 3 and 8, extending between sidewalls 18 and 20 so that upon removal of front wall 14, for example, blower 24 may be moved into and out of interior space 13 of cabinet 12. Intermediate wall 19*a* includes a suitable opening 19*b* formed therein to allow airflow from the blower 24 to be discharged into plenum 17. Plenum 17 is also delimited in part by a vertical intermediate wall 19*c*, FIG. 3. Suitable clearance between the blower sidewalls 32 and 34 and the cabinet sidewalls 18 and 20, respectively, is provided to allow air to flow into the blower inlet openings 40 and 42. FIG. 3 illustrates the typical spacing between the blower spiral end wall 36 and the cabinet walls 14 and 16.

One deficiency of prior art centrifugal airhandling blowers for use with HVAC system cabinets is the poor distribution of inlet airflow to the blower inlet openings 40 and 42, for example. FIG. 3 illustrates flow streamlines 41 indicating the pattern of airflow through the space 13 of cabinet 12 into the blower inlet opening 42. A similar flow pattern may be found for air entering the blower through inlet opening 40 on the opposite side of the blower 24. This inlet airflow pattern is inefficient and can cause flow instability problems with respect to air entering and being acted on by the blades of a centrifugal impeller, such as the impeller 26. In fact, the uneven distribution of inlet airflow may generate additional noise since, as the blower impeller or wheel rotates, the impeller blades tend to be loaded and unloaded with each revolution and, due to the pressure differential experienced on the upper side of the blower inlet opening 42, viewing FIG. 3. Moreover, under such operating conditions, a blower including an impeller with backward inclined impeller blades may approach an aerodynamic stall condition, for example.

Figure 4:
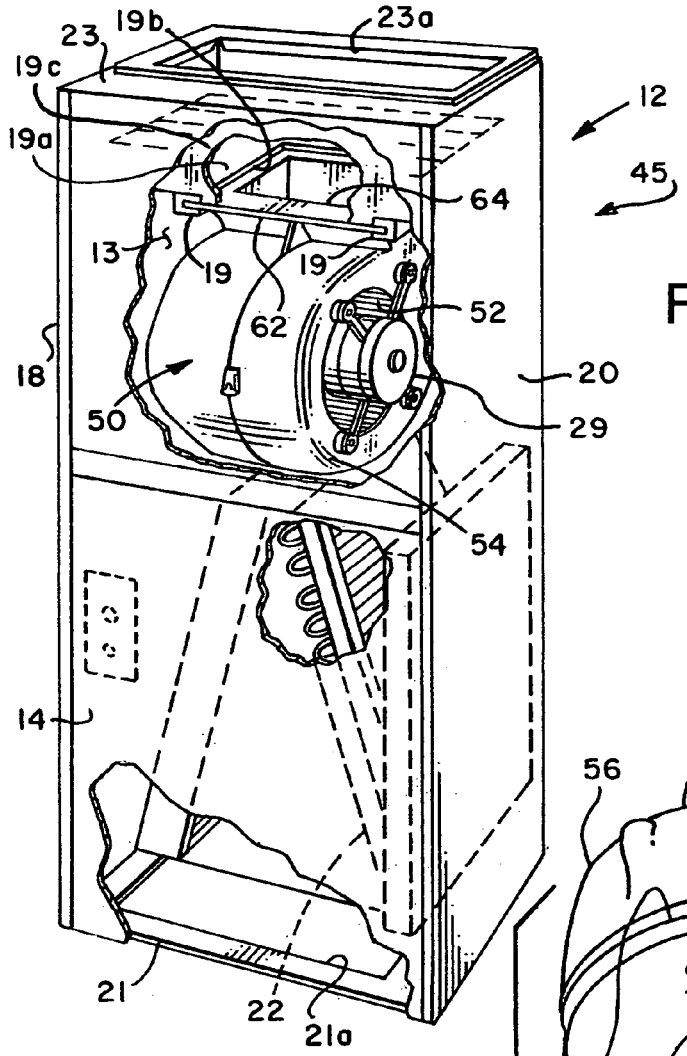
FIG. 4 is a cutaway perspective view of an airhandling apparatus including a blower and cabinet combination in accordance with the invention.
Figure 5:
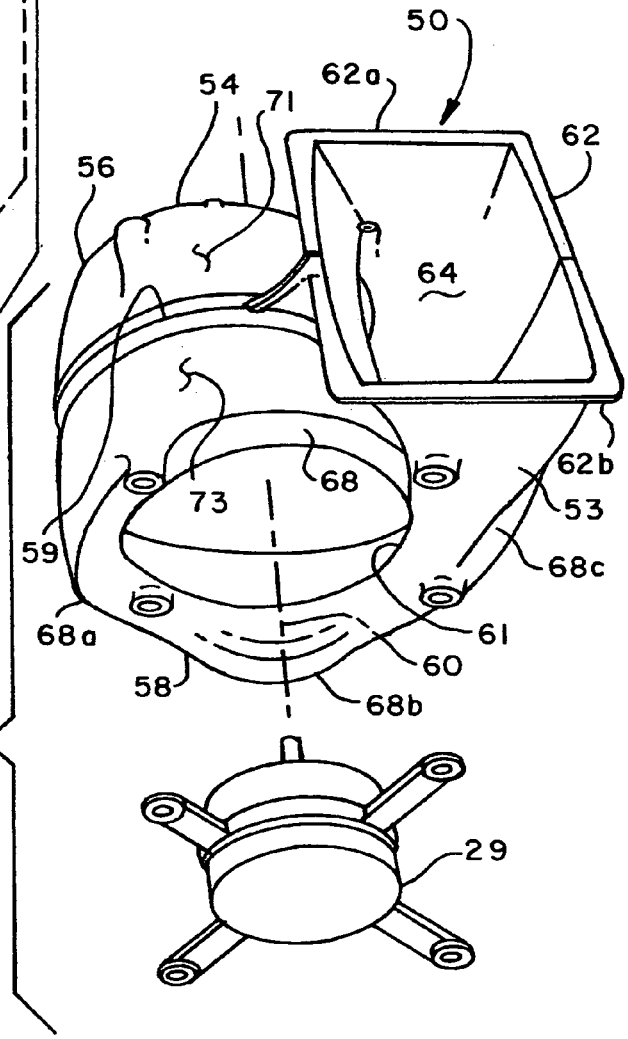
FIG. 5 is an exploded perspective view of the blower housing and impeller drive motor for the blower shown in FIG. 4.

In accordance with the present invention, an improved HVAC apparatus is provided including, in combination, a blower housing and a cabinet, such as the cabinet 12. Referring to FIGS. 4 and 5, in FIG. 4 there is illustrated an HVAC apparatus 45 including an electric motor driven centrifugal blower 50 disposed in the cabinet 12 in place of the blower 24. The blower 50 includes a centrifugal impeller 52, FIG. 4, disposed within a blower housing 54 and driven by an electric motor 29. Blower 50 is of greater airflow capacity than blower 24 while not requiring a larger or different cabinet. In other words, blower 50 may be fitted within the confines of the space 13 of cabinet 12 and is of greater airflow capacity than blower 24. This improvement has been accomplished in one respect by construction of a blower housing as described in my co-pending U.S. patent application Ser. No. 10/461,042, and as further described herein. Blower 50 is also mounted within the cabinet 12 in the same manner as blower 24, however, blower housing 54 is of a configuration which provides for increased airflow handling capability of blower 50 by the unique construction of the blower housing, which includes sidewalls which are not substantially planar and cooperate with an end wall which does not have a continuously increasing radial distance from the axis of rotation of the impeller 52 between the so-called impeller cutoff point and the air discharge plenum portion 53 of the blower housing, FIG. 5.

Figure 6:
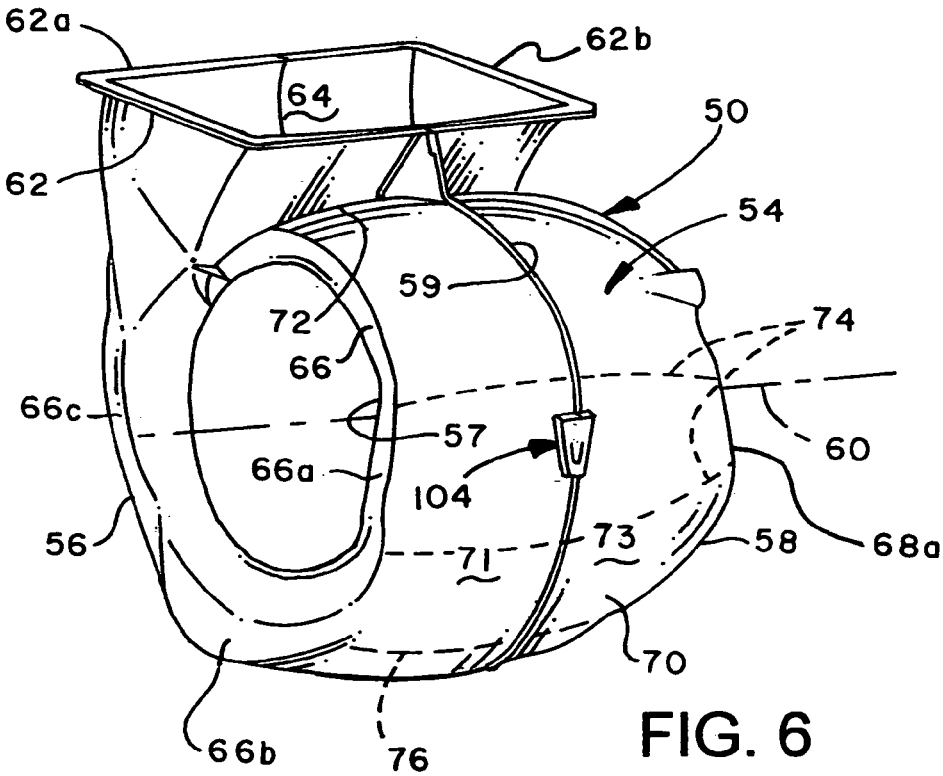
FIG. 6 is a perspective view of the blower housing shown in FIG. 5 taken from another side of the blower housing.

As shown in FIGS. 5 and 6, blower housing 54 is preferably formed of opposed shell-like housing parts 56 and 58, which are joined together along a parting line 59, which parting line preferably is disposed in a plane normal to the axis of rotation 60 of blower motor 29 and the impeller 52. Housing parts 56 and 58 may be formed by a molding or deepdraw stamping process, for example. The housing parts 56 and 58 are preferably formed by compression molding of a thermoset molding material as described in my co-pending U.S. patent application entitled "Composite Airhandling Blower Housing and Method of Assembly," Ser. No. 10/796,703, filed on Mar. 9, 2004. Housing parts 56 and 58, when joined together, form a generally rectangular perimeter flange 62 defining an air discharge opening 64, FIGS. 5 and 6. Housing parts 56 and 58 include respective blower air inlet openings 57 and 61, which are substantially circular about the axis 60. Air inlet openings 57 and 61 are formed in respective sidewalls 66 and 68, which are integrally joined to a continuous end wall 70 formed by respective end wall portions 71 and 73 of the respective housing parts 56 and 58, see FIG. 6.

In order to provide the increased airflow capacity of blower 50, while maintaining the outer envelope dimensions of the blower such that it will fit within cabinet 12, and also provide for suitable blower efficiency, the provision of a substantially constantly increasing cross-sectional airflow area for air being discharged from the blower is not provided solely by constantly increasing the radial distance of the end wall 70 from the axis 60, as is the configuration of conventional centrifugal blowers. With the blower housing 50, for example, the end wall 70 increases in its radial distance from axis 60 from a so-called impeller cutoff point, generally designated by the numeral 72 in FIG. 6, in a clockwise manner, viewing FIG. 6, until the end wall begins to descend vertically, with respect to the orientation of the blower shown in FIGS. 5, 6 and 7. At this point, the radial distance of end wall 70 from axis 60 does not increase at a constant rate over a portion or zone of the end wall generally disposed between dashed lines 74 in FIG. 6, and the radial distance of end wall 70 from axis 60 may even decrease over a part of zone or portion 74.

Figure 7:
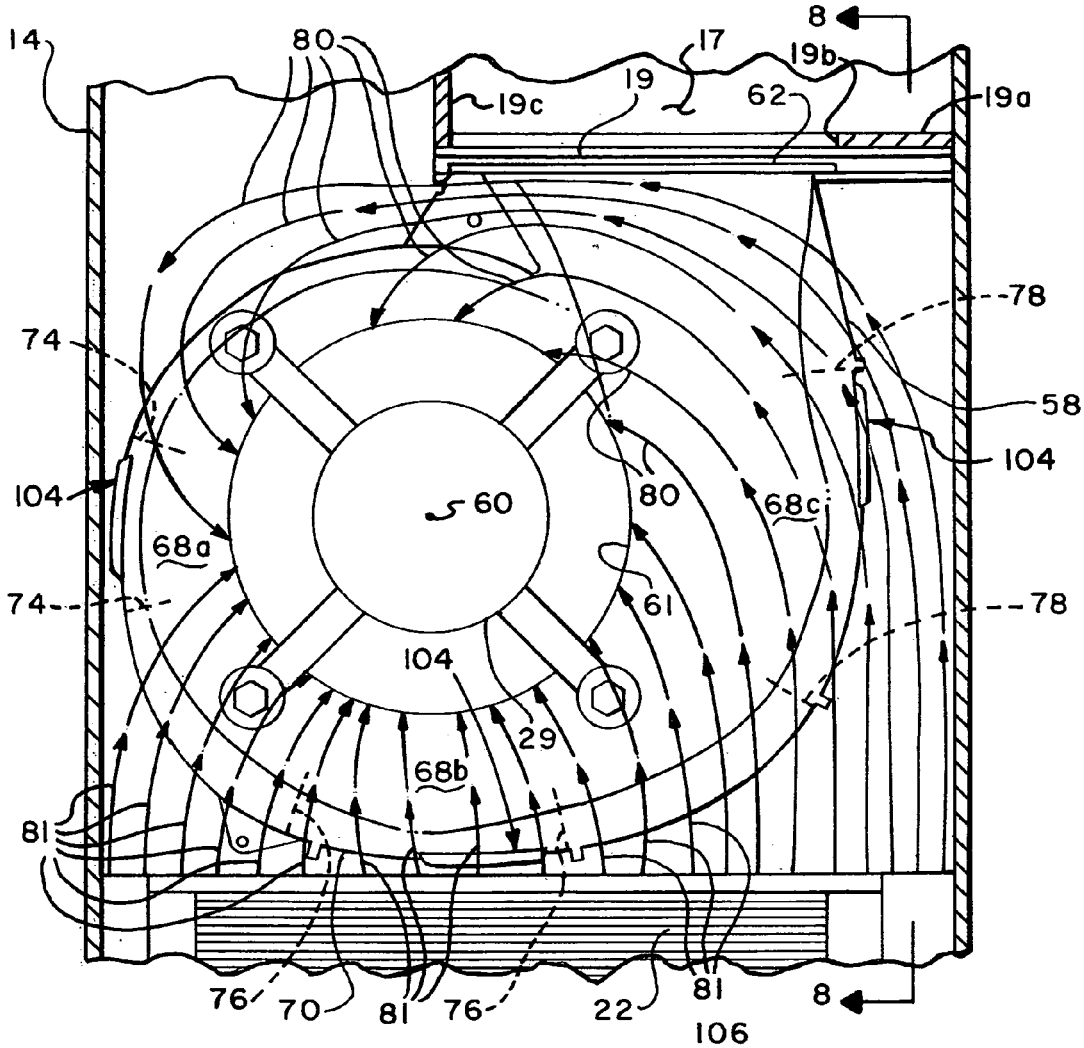
FIG. 7 is a vertical section view of the blower housing disposed in the cabinet shown in FIG. 4 taken from line 7—7 of FIG. 8 and indicating the distribution of inlet airflow realized with the blower housing and cabinet combination of the present invention.
Figure 8:
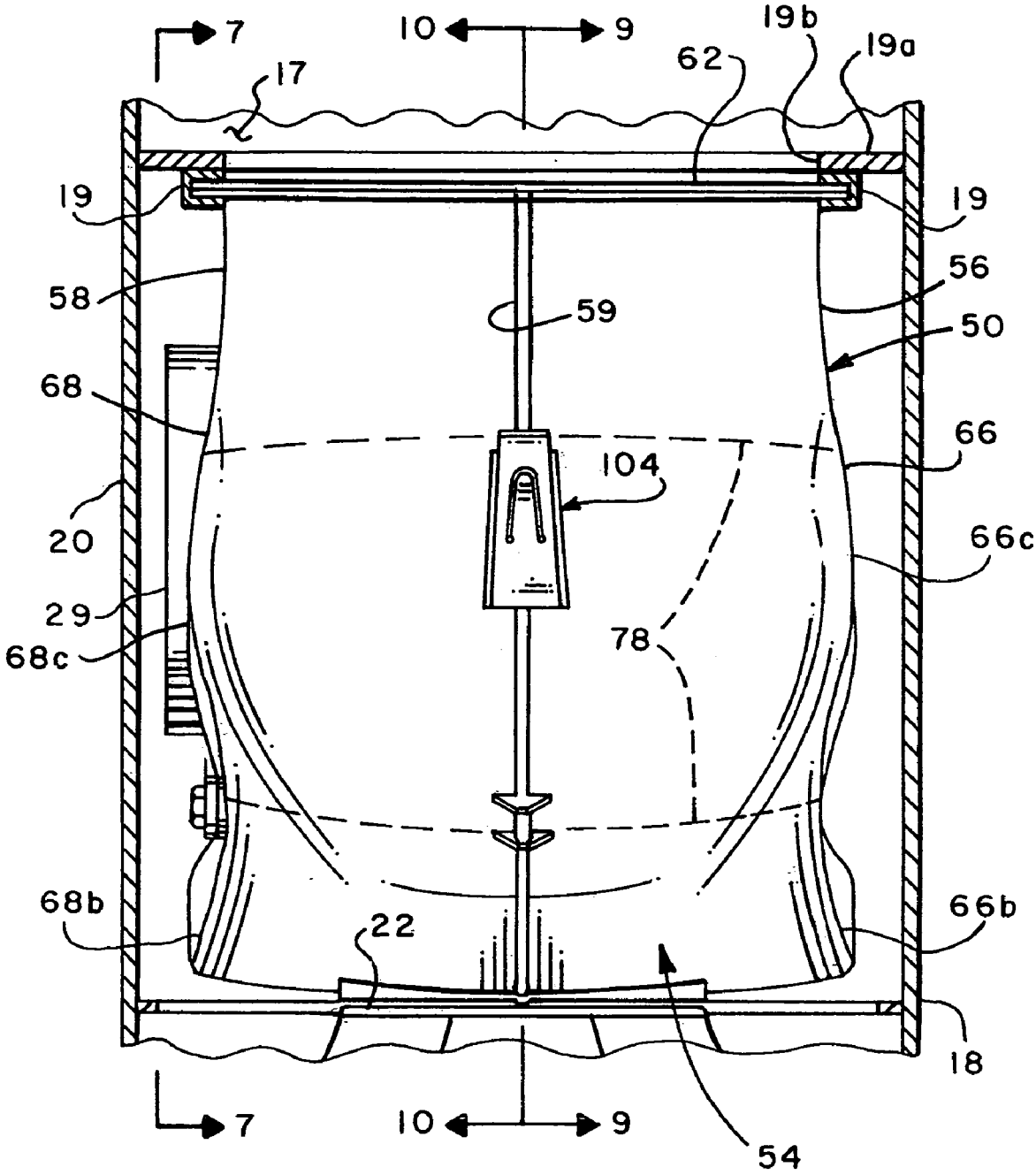
FIG. 8 is a view of the blower housing taken generally from the line 8—8 of FIG. 7.

A second portion or zone of end wall 70 is that which is disposed generally between dashed lines 76, see FIGS. 6 and 7, and which also does not continuously increase its radial distance from the axis 60, as shown. At the end wall zones or portions 74 and 76, sidewalls 66 and 68 are provided with axially extending portions 66*a* and 68*a* and 66*b* and 68*b*, as shown in FIGS. 6 and 5, respectively. A third portion of end wall 70 is shown in FIG. 8 as that portion or zone between the dashed lines 78 and which still further does not continuously increase its radial distance from axis 60, see FIG. 7 also. Along zone 78, the sidewalls 66 and 68 are provided with still further axially extending portions 66*c* and 68*c*, see FIGS. 6 and 5. The radial distance of end wall 70 from axis 60, in zones 76 and 78, may also actually decrease over at least part of these zones. In this way, the blower housing 50 is provided with a substantially constantly increasing cross-sectional airflow area with respect to axis 60 from the so-called cutoff point 72, generally to the discharge opening 64, and this configuration of blower housing 50 allows the housing to be fitted within the cabinet 12 without modifying the cabinet dimensions. For example, viewing FIG. 7, it is indicated how the somewhat flattened portion 74 of end wall 70 is disposed closely adjacent to front wall 14 and how zone or portion 76 of end wall 70 is disposed closely adjacent to heat exchanger 22. As shown in FIG. 8, blower housing 54 is spaced from sidewalls 18 and 20 of cabinet 12 to allow airflow between the cabinet sidewalls and the sidewalls 66 and 68 of the blower housing. However, the contoured or axially extended portions of the sidewalls, namely portions 66*a*, 66*b*, 66*c*, 68*a*, 68*b*, and 68*c*, are located such that improved airflow distribution is provided between the blower housing 54 and the cabinet sidewalls for airflow entering the inlet openings 57 and 61.

Referring further to FIG. 7, there is illustrated an improved airflow pattern into the inlet opening 61 of blower housing part 58. Flow streamlines 80 indicate that airflow upward through heat exchanger 22 enters blower inlet opening 61 throughout that portion of the circumference of inlet opening 61 and the inlet opening flow area above the axis 60, viewing FIG. 7. This improved airflow distribution exists for both inlet openings 57 and 61, respectively, and is indicated to be due to the axially projecting or axially extending portions 66*a*, 66*b*, 66*c* and 68*a*, 68*b* and 68*c* of the sidewalls 66 and 68, which reduce the space between the blower housing sidewalls and the cabinet sidewalls 18 and 20 in a region above the heat exchanger 22. The improved airflow distribution is indicated to be due to the airflow guiding effect of the axially extending portions of sidewalls 66 and 68. The improved airflow distribution is also due to the close proximity of blower end wall 70 to front wall 14, to heat exchanger 22 and, to a somewhat lesser extent, the location of end wall 70 in the region directly adjacent the cabinet wall 16. Thus, as airflow passes through heat exchanger 22, the axially extending sidewall portions 66*a*, 68*a*, 66*b*, 68*b*, and 66*c*, 68*c* cause air to be drawn in through the blower housing inlet openings 57 and 61 in a substantially uniform distributed manner, as indicated by the flow streamlines 80, above the axis 60 and the flow streamlines 81, below the axis 60, viewing FIG. 7. The airflow pattern shown in FIG. 7 is a mirror image of the flow pattern of air entering blower housing inlet opening 57, see FIG. 6. Accordingly, airflow into air inlet openings 57 and 61 is substantially uniform about at least a major portion of the circumferences of the inlet openings, respectively. In this way, it is indicated that a blower, such as the blower 50, shows improved efficiency, quieter operation and with a reduced tendency of the blower impeller to approach an unstable airflow condition over any portion of the inlet flow path to the impeller blades.

Figure 11:
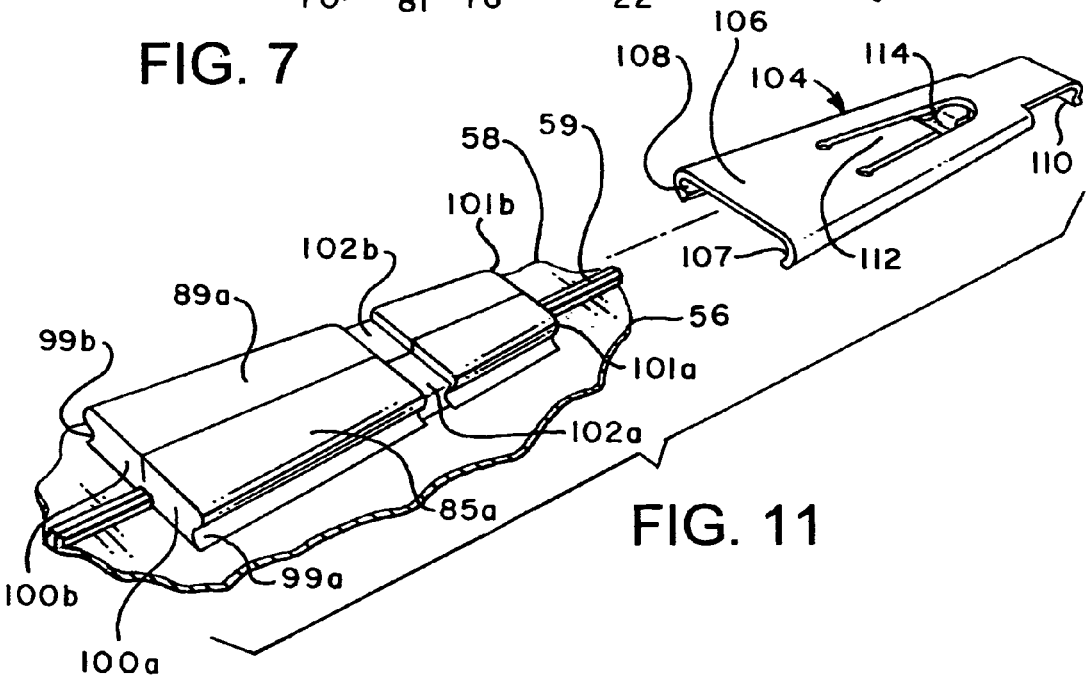
FIG. 11 is a detail perspective view illustrating one preferred arrangement for fastening the blower housing parts together.
Figure 9:
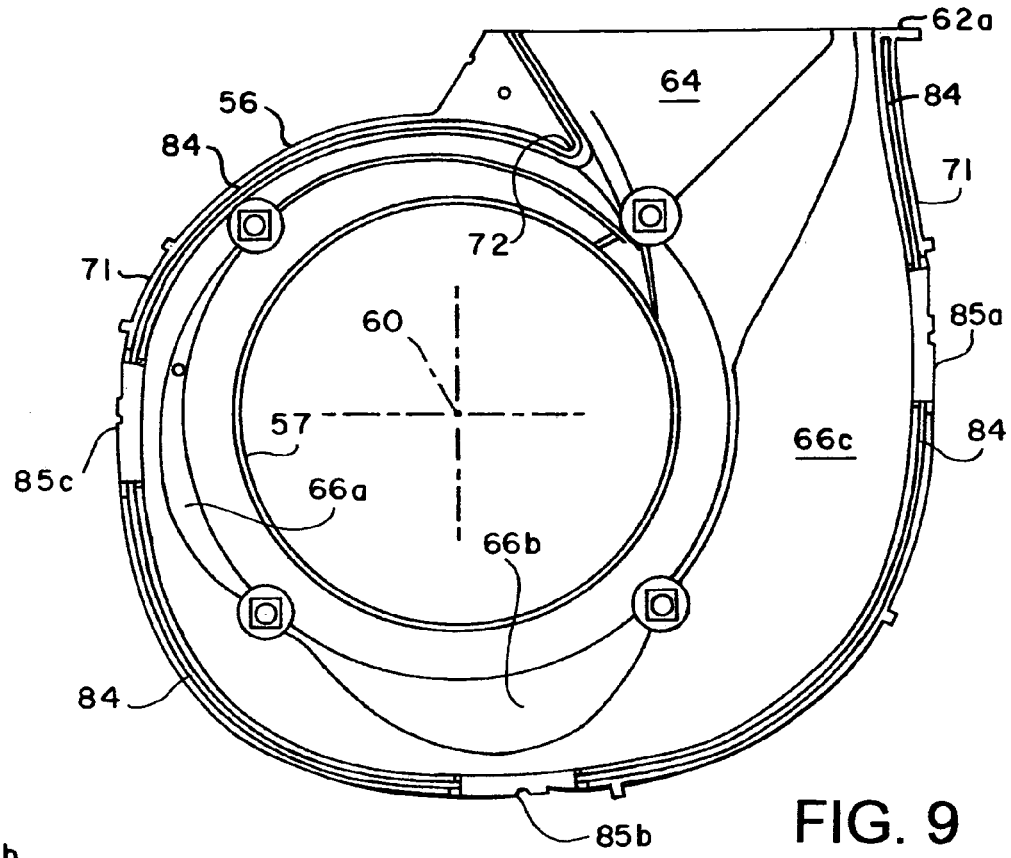
FIG. 9 is a view taken generally from the line 9—9 of FIG. 8 showing the configuration of one part of the blower housing.
Figure 10:
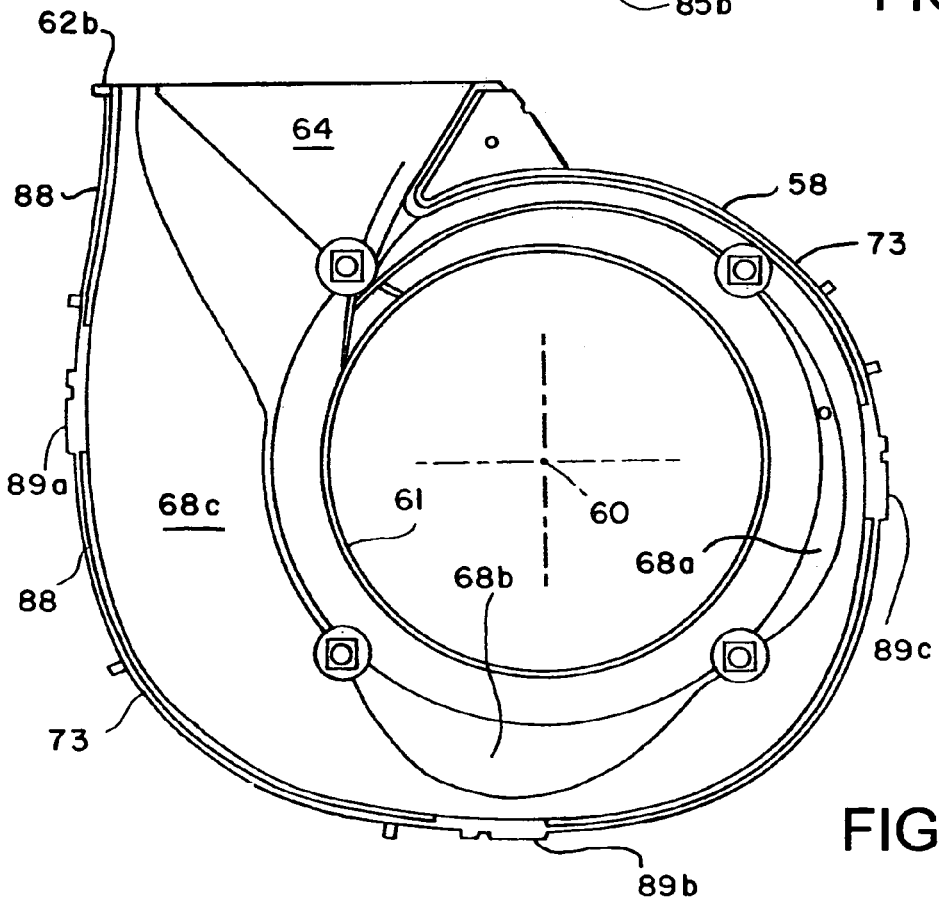
FIG. 10 is a view taken generally from the line 10—10 of FIG. 8 showing the configuration of the other part of the blower housing.

Referring now to FIGS. 9, 10 and 11, the blower housing parts 56 and 58 are shown in elevation view in FIGS. 9 and 10 and showing the interiors of the housing parts. As shown in FIG. 9, housing part 56 is provided with an axially extending perimeter groove 84 formed in end wall 71 and extending substantially from the cutoff point 72 to outlet flange part 62*a*. Groove 84 is intercepted at three spaced apart points by respective elongated tapered bosses 85*a*, 85*b* and 85*c*. In like manner, blower housing part 58 includes a perimeter flange 88, which is configured to fit within groove 84. Perimeter flange 88 is formed as part of end wall 73 of housing part 58 and projects normal to a plane which includes the housing parting line 59. Spaced apart elongated tapered bosses 89*a*, 89*b* and 89*c* are formed along the end wall 73 of housing part 58 and are complementary to the bosses 85*a*, 85*b* and 85*c* of housing part 56 when the two housing parts are joined, as illustrated in FIGS. 4, 5, 6, and 8, for example.

The blower housing parts 56 and 58 are secured together at the respective sets of bosses 85*a*, 89*a*, 85*b*, 89*b*, and 85*c*, 89*c*, respectively. FIG. 11 illustrates a typical configuration of the aforementioned bosses and illustrates the bosses 85*a* and 89*a* aligned with each other. The bosses 85*a* and 89*a* are each provided with re-entrant tapered sidewalls 99*a* and 99*b*, which taper from respective end walls 100*a* and 100*b* to opposite end walls 101*a* and 101*b*. Cooperating grooves 102*a* and 102*b* are formed between the opposite end walls of the respective bosses 85*a* and 89*a*. As further shown in FIG. 11, a tapered metal clip, or cleat, 104 is characterized by a generally planar body part 106 and opposed inwardly turned flanges 107 and 108, which taper toward a depending transverse flange 110. A cantilever, elastically deflectable detent member 112 is provided with a projection 114, which is operable to fit in the aligned grooves 102*a* and 102*b* when the clip 104 is slideably engaged in wedging relationship with the cooperating bosses 85*a* and 89*a*. Clips 104 are also operable to secure the housing parts 66 and 68 together at the respective cooperating pairs of bosses 85*b*, 89*b* and 85*c*, 89*c*, respectively. My co-pending U.S. patent application entitled "Composite Airhandling Blower Housing and Method of Assembly" also describes novel features of the blower housing 54 and its method of assembly.

The HVAC apparatus 45, including the combination of the airhandling cabinet 12 and blower 50, together with the construction of the blower housing 54 and the improved relationship between the blower housing and the cabinet, is believed to be readily understandable to those of skill in the art based on the foregoing description. Conventional engineering methods and materials may be used in constructing the airhandling apparatus 45 illustrated in FIG. 4, the blower 50 and the blower housing 54 except, as previously discussed, the blower housing 54 may be advantageously compression molded of a thermoset polymer material including that which is described in my co-pending patent application referenced hereinabove.

Although a preferred embodiment of the invention has been described in detail herein, those skilled in the art will also recognize that various substitutions and modifications may be made without departing from the scope and spirit of the appended claims.

What is claimed is:

1. In an air handling unit for an HVAC system, a combination comprising a cabinet including an air inlet opening and an air discharge opening, a centrifugal, motor driven air handling blower disposed in said cabinet, said blower including a blower housing having opposed sidewalls, portions of which extend axially with respect to an axis of rotation of an impeller of said blower in opposite directions toward opposed walls of said cabinet providing a flow path for air flowing into said cabinet and into at least one air inlet opening of said blower and providing for distribution of airflow entering said inlet opening of said blower with respect to said axis along flow streamlines which extend to said inlet opening substanially all of said inlet opening;

wherein each of said sidewalls of said blower housing includes at least one axially extending portion configured in combination with an end wall of said blower housing to provide a substantially continuously increasing cross-sectional flow area for throughput air of said blower housing, said axially extending sidewall portions being disposed adjacent an end wall portion of said blower housing; and wherein said blower housing includes at least three circumferentially spaced axially extending portions of said sidewalls of said blower housing, respectively, and disposed adjacent corresponding portions of said end wall of said blower housing.

2. The invention set forth in claim 1 wherein:

said cabinet is substantially rectangular in shape and includes opposed sidewalls disposed adjacent and spaced from said opposed sidewalls of said blower housing, respectively, and said cabinet includes at least one wall extending transversely to said sidewalls of said cabinet and disposed directly adjacent a portion of an end wall of said blower housing.

3. The invention set forth in claim 1 wherein:

said blower includes an air discharge opening formed by said blower housing and oriented for discharging air from said blower toward an air discharge opening of said cabinet.

4. The invention set forth in claim 1 wherein:

said cabinet includes a heat exchanger disposed directly adjacent a portion of an end wall of said blower housing whereby at least one axially extending portion of each of said sidewalls of said blower housing is disposed adjacent said heat exchanger and such as to force airflow toward opposed inlet openings in said blower housing to be diverted around said at least one axially extending portion of each of said sidewalls of said blower housing, respectively.

5. The invention set forth in claim 4 including:

at least one axially extending portion of each of said sidewalls of said blower housing disposed directly adjacent a wall of said cabinet.

6. The invention set forth in claim 1 wherein:

said blower housing is formed of two opposed housing parts joined along a parting line which is substantially normal to said axis.

7. The invention set forth in claim 6 wherein:

said housing parts are releasably connected to each other by spaced apart clips, said clips being cooperable with bosses formed on said housing parts, respectively, for securing said housing parts to each other.

8. The invention set forth in claim 1 wherein:

said blower is supported in said cabinet on opposed rails, said rails cooperating with a flange formed on said blower for suspending said blower in said cabinet.

9. In an air handling unit for an HVAC system, a combination comprising a cabinet including an air inlet opening and an air discharge opening, a centrifugal, motor driven air handling blower disposed in said cabinet, said blower including a blower housing having opposed sidewalls, each having a generally circular air inlet opening formed therein, plural spaced apart portions of said blower housing sidewalls extending axially with respect to an axis of rotation of an impeller of said blower in opposite directions toward opposed walls of said cabinet and providing a flow path for air flowing into said cabinet and into one of said air inlet openings of said blower which distributes airflow entering said at least one inlet opening of said blower with respect to said axis along flow streamlines which extend over substanially all of said at least one inlet opening;

wherein said axially extending portions of said sidewalls of said blower housing are configured in combination with an end wall of said blower housing to provide a substantially continuously increasing cross-sectional flow area for throughput air of said blower housing, and said axially extending portions of said sidewalls of said blower housing are disposed adjacent an end wall portion of said blower housing disposed at a variable predetermined radial distance from said axis.

10. The invention set forth in claim 9 wherein:

at least one axially extending portion of each of said sidewalls of said blower housing is disposed directly adjacent a wall of said cabinet.

11. The invention set forth in claim 9 wherein:

said blower housing includes at least three circumferentially spaced axially extending portions of said sidewalls of said blower housing and disposed adjacent corresponding portions of said end wall of said blower housing which are disposed at variable predetermined radial distances from said axis.

12. The invention set forth in claim 9 wherein:

said blower housing is formed of two opposed housing parts joined along a parting line which is substantially normal to said axis.

13. An HVAC apparatus including a combination comprising a generally rectangular cabinet including an air inlet opening and an air discharge opening, a centrifugal, motor driven air handling blower disposed in said cabinet, said blower including a blower housing having opposed sidewalls each having a blower air inlet opening formed therein, each of said blower housing sidewalls include circumferentially spaced apart portions which extend axially with respect to an axis of rotation of an impeller of said blower in opposite directions toward opposed walls of said cabinet and providing a flow path for air flowing into said cabinet and into said air inlet openings of said blower whereby airflow entering said inlet openings of said blower housing is distributed over substanially all of said air inlet openings of said blower housing, respectively;

wherein at least one axially extending portion of each of said sidewalls of said blower housing is disposed directly adjacent a wall of said cabinet, and said axially extending portions of said sidewalls are configured in combination with an end wall of said blower housing to provide a substantially continuously increasing cross-sectional flow area for throughput air of said blower housing; and wherein said blower housing includes at least three circumferentially spaced axially extending portions of said sidewalls of said blower housing.

14. The apparatus set forth in claim 13 wherein:

said blower housing is formed of two opposed housing parts joined along a parting line which is substantially normal to said axis.

* * * * *